US007267570B2

(12) United States Patent
Fry, Jr. et al.

(10) Patent No.: US 7,267,570 B2
(45) Date of Patent: Sep. 11, 2007

(54) DOUBLE BEAM LATCH CONNECTOR

(75) Inventors: Daniel W Fry, Jr., Elizabethtown, PA (US); Douglas J Hardy, Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/485,885

(22) Filed: Jul. 13, 2006

(65) Prior Publication Data

US 2007/0020986 A1 Jan. 25, 2007

Related U.S. Application Data

(60) Provisional application No. 60/702,085, filed on Jul. 22, 2005.

(51) Int. Cl.
*H01R 13/627* (2006.01)

(52) U.S. Cl. ..... 439/357; 439/358

(58) Field of Classification Search ..... 439/352, 439/354, 357, 358
See application file for complete search history.

(56) References Cited

U.S. PATENT DOCUMENTS 4,449,767 A * 5/1984 Weidler ..... 439/64
4,640,566 A 2/1987 Matsusaka
4,979,910 A * 12/1990 Revil et al. ..... 439/357
5,110,302 A 5/1992 Kobler
5,308,261 A 5/1994 Kightlinger
6,146,183 A * 11/2000 Jinno et al. ..... 439/358
6,419,515 B1 * 7/2002 Okayasu ..... 439/358
6,561,834 B2 * 5/2003 Chen ..... 439/358
6,902,420 B2 * 6/2005 Muro et al. ..... 439/358
2002/0119693 A1 8/2002 Chen
2003/0194899 A1 10/2003 Ueda
2004/0166717 A1 8/2004 Muro
2006/0105611 A1 5/2006 Toyoda

* cited by examiner

*Primary Examiner*—Tho D. Ta

(57) ABSTRACT

A connector assembly including a first connector attachable to a first electrical component and a second connector attachable to a second electrical component and releasably engaged with the first connector. The second connector includes a housing, a latch member and a hinge hingedly attaching the latch member to a surface of the housing. The hinge includes at least one beam extending from the latch member to the surface of the housing and curving 90 degrees from the latch member. The latch member includes a push portion at one end and a lock engagement portion at an opposite end. Push portion has an upper push surface configured to receive a force and an opposing lower surface facing the outer surface of the housing and defining a space between outer surface and push portion. The lower surface includes a rib protruding into the space between the outer surface and push portion.

19 Claims, 10 Drawing Sheets

DOUBLE BEAM LATCH CONNECTOR

This application claims the benefit of priority under 35 U.S.C. §119(e) to provisional application Ser. No. 60/702,085, filed on Jul. 22, 2005 and entitled DOUBLE BEAM LATCH CONNECTOR.

BACKGROUND

The present invention relates to electrical connector assemblies for electrically connecting electronic devices to one another and, more particularly, to an improved mechanism for releasably securing the connector members of such an electrical connector assembly to one another.

Electrical connectors are used in many different applications and industries to electrically connect two electronic components or cables to one another. Such connectors typically include a male member coupled to an end of an electronic component cable and a female member coupled to an end of another electronic component cable. The male and female members are engagable with one another to electrically connect the two cables. Some such connectors also include latching systems that further secure the engagement between male and female members. Industry standards, such as FAKRA and USCAR, have been developed to identify connectors, particularly those in the automotive industry, as having certain characteristics and qualifications. For instance, FAKRA standards require connector assemblies to have a minimum pull out strength (i.e. the amount of strength or force needed to disengage the male member from the female member) to prevent inadvertent disconnection. On the other hand, it may be desirable to provide a latching mechanism that allows for easily and deliberately disengaging the connector members. It would be of further benefit if such a latching system was robust enough to resist damage during shipping, installation and use.

SUMMARY

The present invention provides an electrical connector assembly for connecting first and second electronic components to one another. In one form, the electrical connector assembly includes a first connector member attachable to the first electrical component and a second connector member attachable to the second electrical component and releasably engaged with the first connector member. The first connector member has a first housing. The second connector includes a second housing, a latch member and a hinge hingedly attaching the latch member to a surface of the second housing. The hinge includes at least one beam extending from the latch member to the surface of the second housing. The at least one beam curves 90 degrees extending from the latch member.

In another form, the electrical connector assembly includes a first connector member attachable to the first electrical component and having a first housing. The electrical connector assembly also includes a second connector member attachable to the second electrical component and releasably engaged with the first connector member. The second connector member includes a second housing, a latch member and a hinge hingedly attaching the latch member to an outer surface of the second housing. The latch member includes a push portion at one end and a lock engagement portion at an opposite end. The push portion has an upper push surface configured to receive a force and an opposing lower surface facing the outer surface of the second housing and defining a space between the outer surface and the push portion. At least one of either the lower surface or the outer surface includes at least one rib protruding into the space between the outer surface and the push portion.

In yet another form, the present invention provides an electrical connector for releasably coupling with a connector of a first electrical component to couple the first electrical component with a second electrical component. The electrical connector includes a housing having a component end adapted to attach to the second electrical component and a connector end adapted to couple with the connector of the first electrical component. The housing includes an outer surface. The electrical connector also includes a latch member having a push portion at one end and a lock engagement portion at an opposite end. The push portion has an upper push surface configured to receive a force and an opposing lower surface facing the outer surface of the housing and defining a space between the outer surface and the push portion. A hinge hingedly attaches the latch member to the outer surface of the housing. The hinge includes at least one beam extending from the latch member to the outer surface of the housing. The at least one beam has a curve portion curving 90 degrees from the latch member. At least one of the lower surface and the outer surface includes at least one rib protruding into the space between the outer surface and the push portion.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
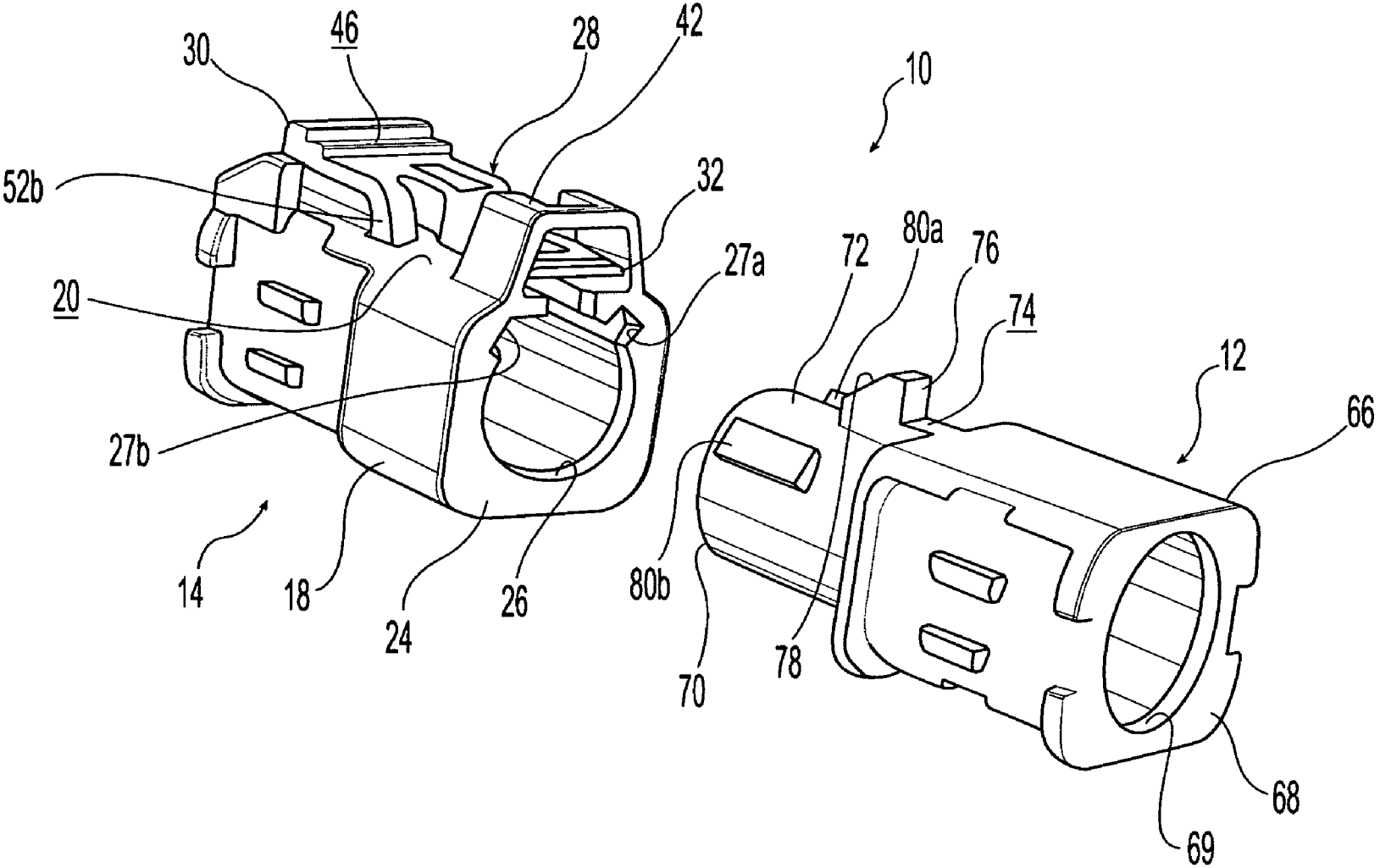
FIG. 1 is a perspective view of an uncoupled electrical connector assembly in accordance with one embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

Referring first to FIG. 1, connector assembly 10 in accordance with one embodiment of the present invention is illustrated. Connector assembly 10 generally includes first connector member 12 and second connector member 14, which may be releasably coupled to one another, as described in further detail below. Each of first and second connector members 12, 14 is adapted to be coupled to an electronic device (not shown), as described in further detail below, such that when first and second connector members 12, 14 are releasably coupled to one another, the electronic devices (not shown) to which they are coupled are electrically connected.

Figure 2:
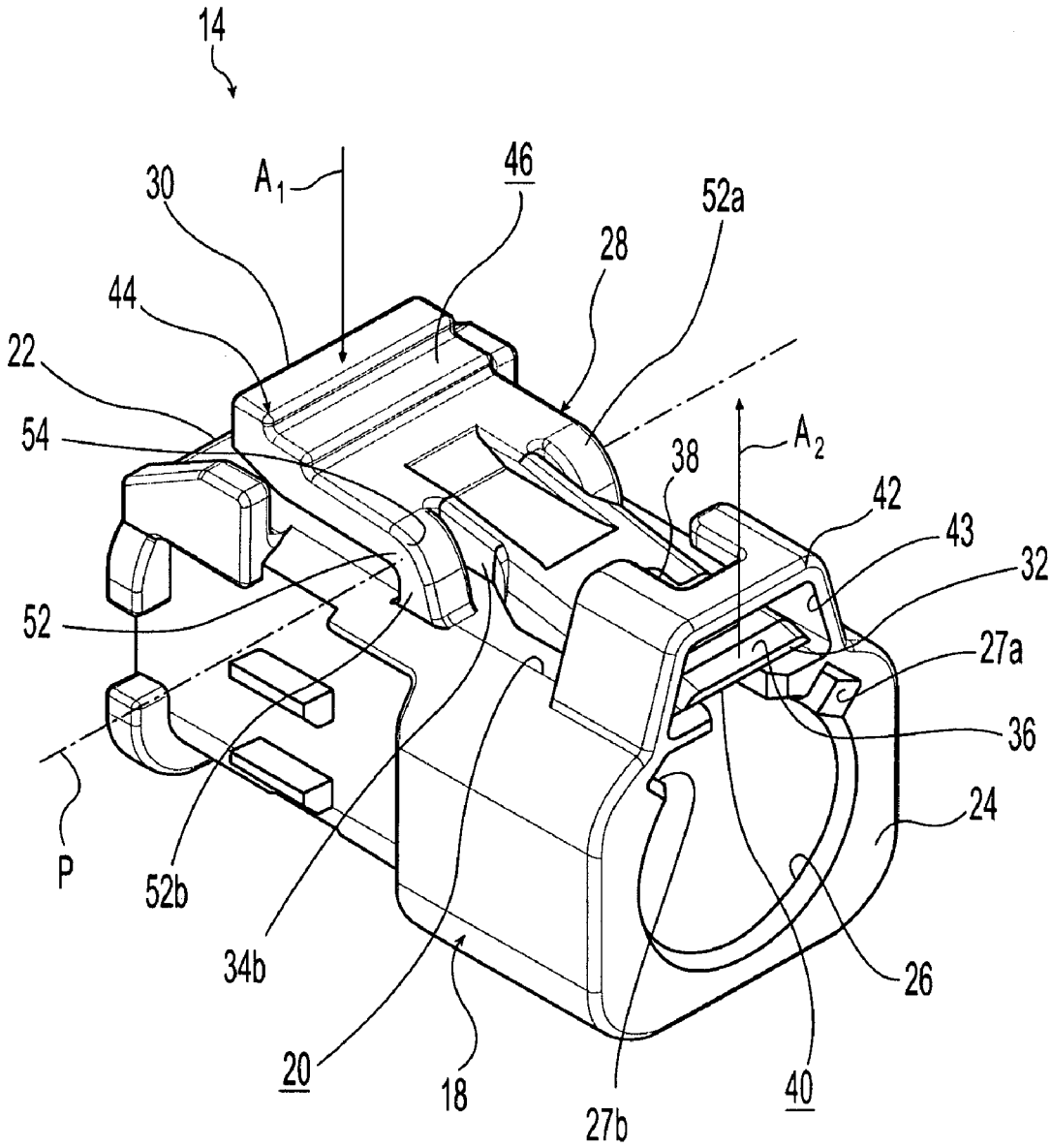
FIG. 2 is a perspective view of the second, female connector member of connector assembly of FIG. 1.
Figure 3:
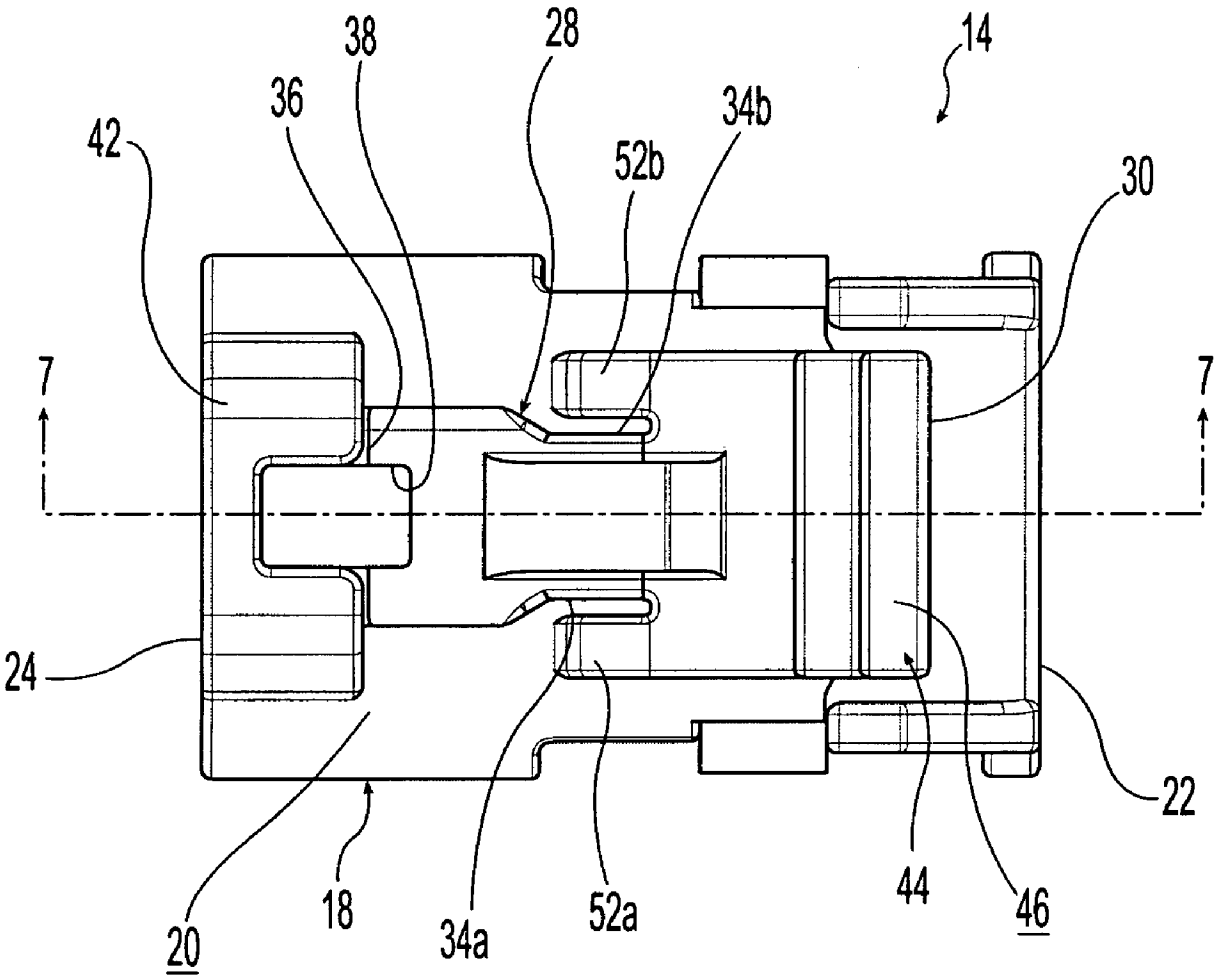
FIG. 3 is a top view of the connector member of FIG. 2.
Figure 4:
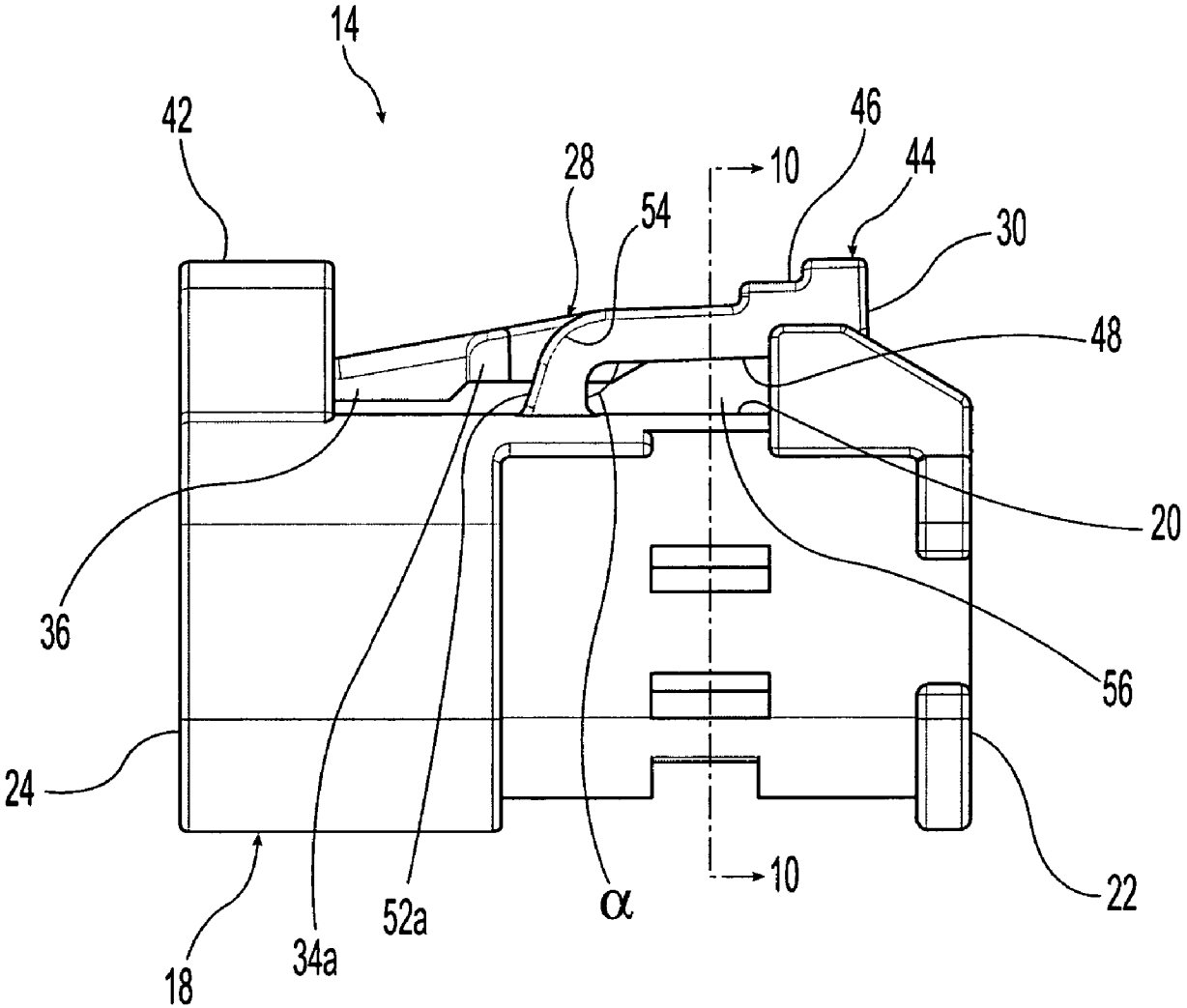
FIG. 4 is a side view of the connector member of FIG. 2.
Figure 7:
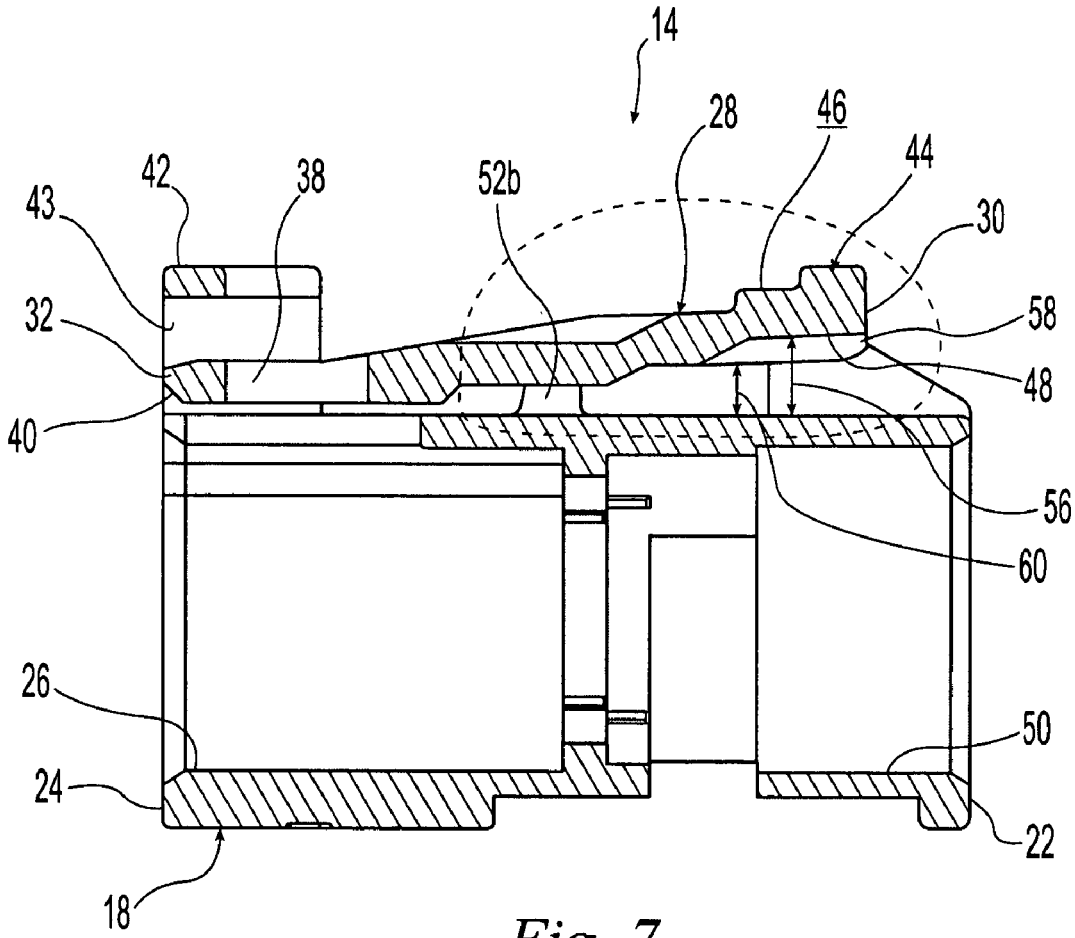
FIG. 7 is a sectional view of the connector member of FIG. 3 taken along line 7-7.

Referring now to FIGS. 1-5, second connector member 14 generally includes housing 18 and latch member 28. Latch member includes hinge portion 52 hingedly coupled to housing 18. As shown in FIGS. 3, 4 and 7, housing 18 is defined by outer surface 20 and extends between first end or component end 22 and second end or connector mating end 24. Component end 22 includes component receiving opening 50 for receiving and/or holding a cable, which in turn connect to a component of an electronic device (not shown). Such a component may be in the form of the plug end of an electric cable adapted to transmit electronic signals to and from the electronic device. The cable may include a bundle of wires and/or electrical contacts positioned in a particular array. Component receiving opening 50 may be adapted to receive such electronic components in any known manner.

Turning to FIGS. 1-2, 5 and 7, connector end 24 of second connector member 14 forms a female member in the form of male member receiving opening 26. Opening 26 is configured to receive male member 72, as shown in FIG. 1 and described in further detail below. As shown in FIGS. 1 and 2, notches 27*a*, 27*b* are formed in the wall defining opening 26 and, as discussed below, aid in the proper alignment of male member 72 with opening 26. Housing 18 also includes latch guard 42 protruding from outer surface 20 and defining latch chamber 43. Latch chamber 43 is configured to loosely receive a portion of latch member 28.

Figure 5:
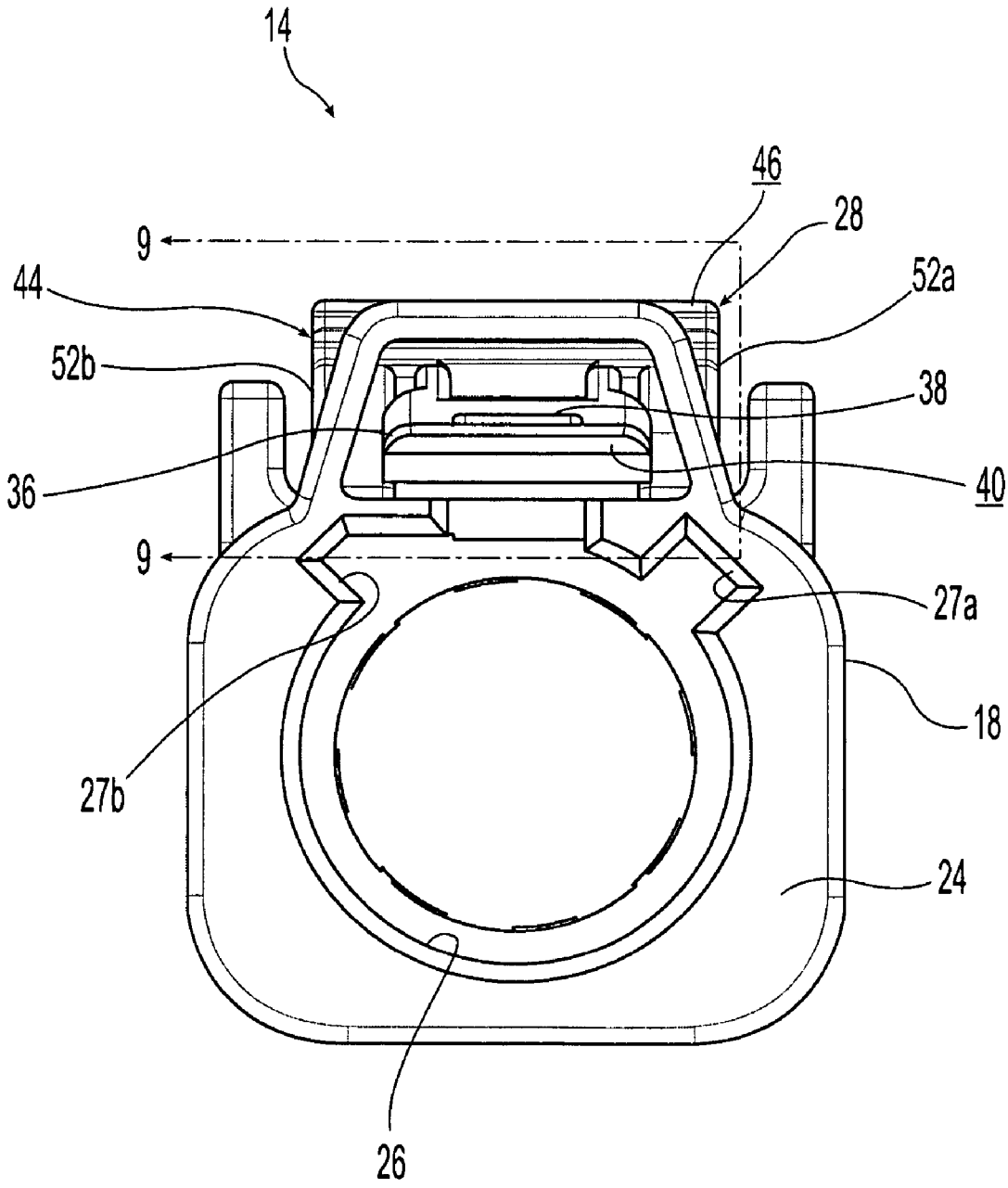
FIG. 5 is an end view of the connector member of FIG. 2.
Figure 6:
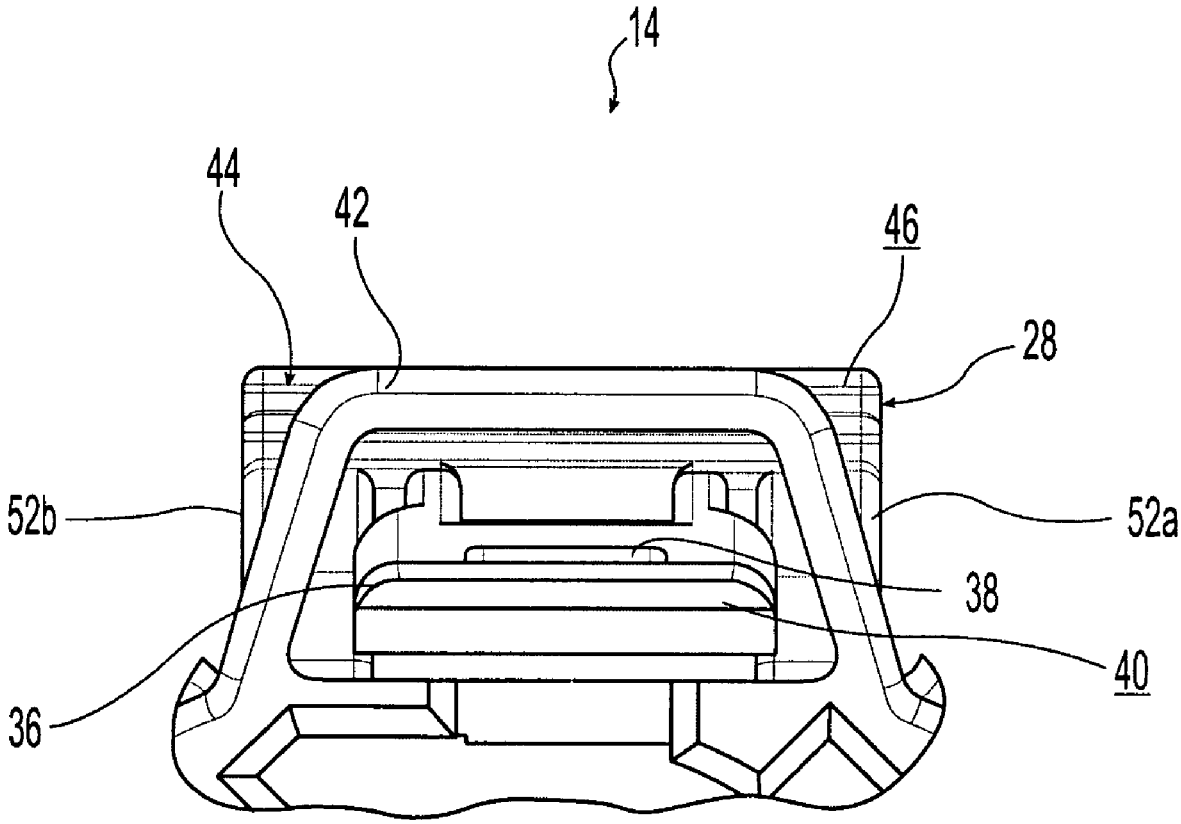
FIG. 6 is an enlarged view of the upper portion of the connector member of FIG. 5.

Referring to FIGS. 2 and 3, latch member 28 includes push end 30, opposing lock end 32, and opposing sides 34*a*, 34*b* extending the length of latch member 28 between push end 30 and lock end 32. Referring specifically to FIGS. 2 and 5-7, latch member 28 includes lock engagement portion 36 near end 32. Lock engagement portion 36 includes lock receiving opening 38 extending therethrough. Lock receiving opening 38 is configured to receive and capture lock member 76 of first connector member 12, shown in FIGS. 1 and 11-12 and described in further detail below. As illustrated in FIGS. 2, 5 and 6, lock engagement portion 36 has sloped end surface 40 and is moveably housed within latch chamber 43.

Figure 8:
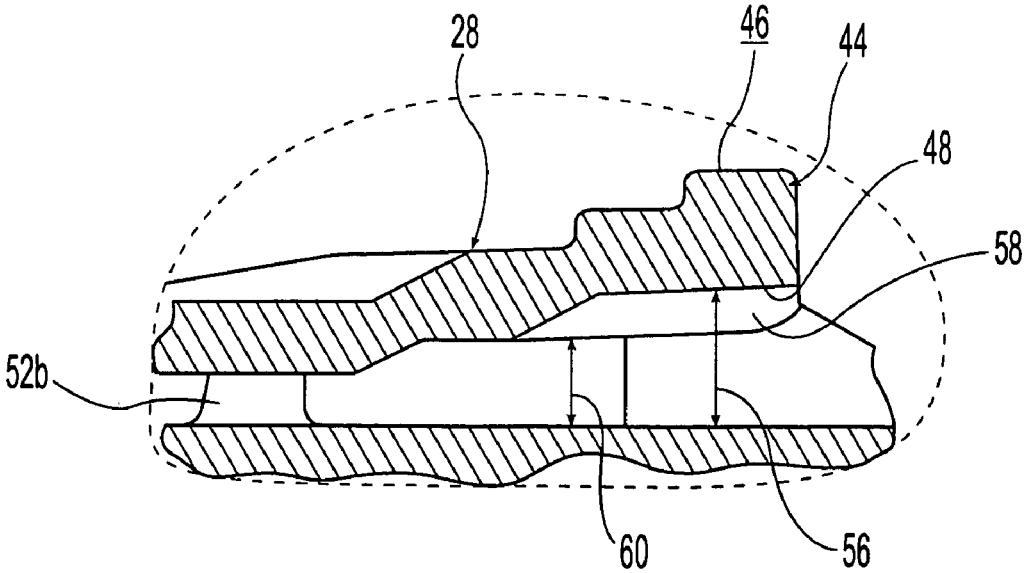
FIG. 8 is an enlarged view of the encircled region of the connector member of FIG. 7.
Figure 9:
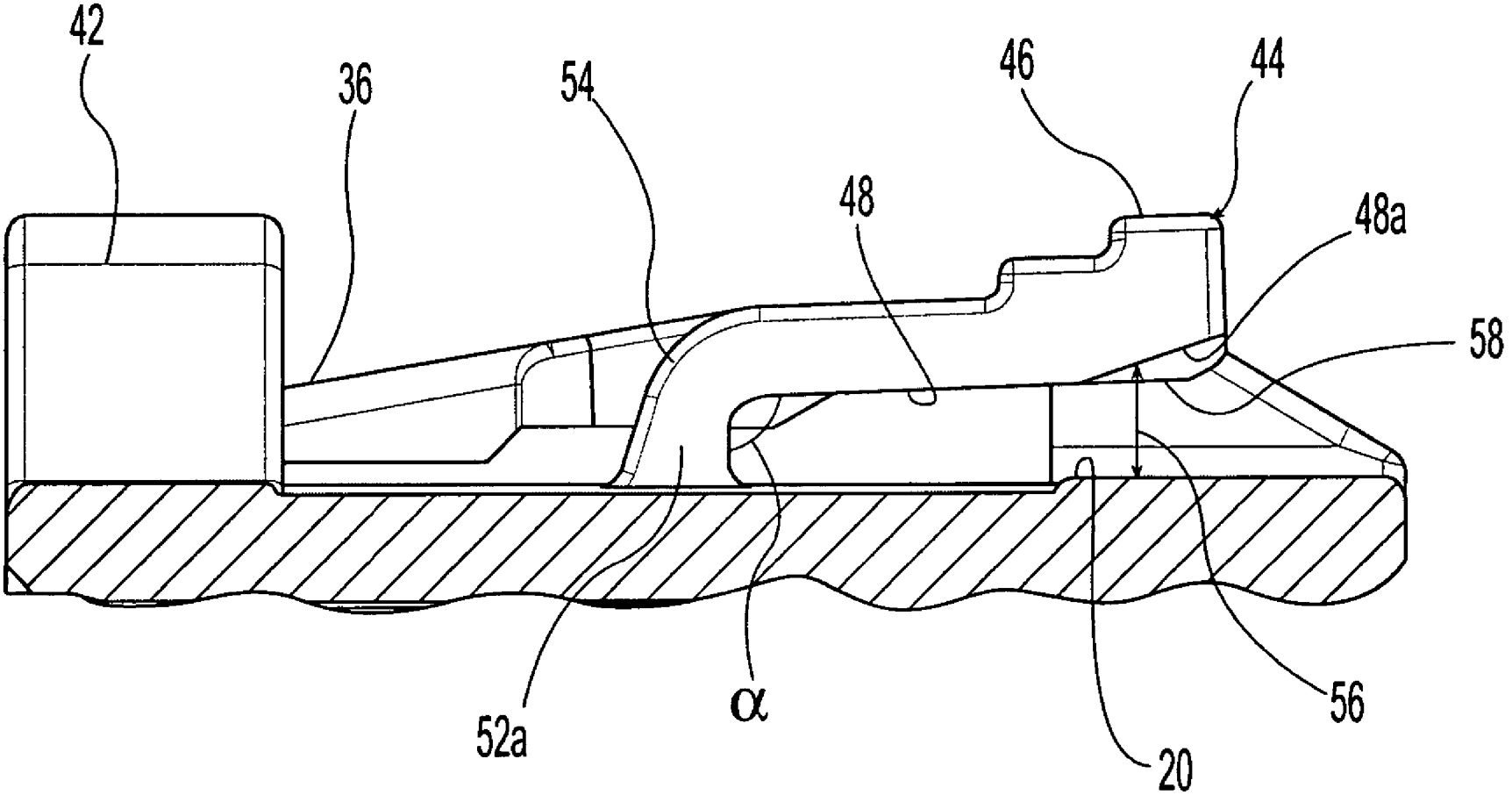
FIG. 9 is a partial sectional view of the connector member of FIG. 5 taken along line 9-9.

Referring to FIGS. 2-4 and 7-10, latch member 28 forms push portion 44. Push portion 44 includes upper push surface 46 (FIG. 2) and opposing lower surface 48 (FIGS. 7-8). Upper push surface 46 is adapted to receive a force, such as that which may be applied by a person's finger or thumb in the direction of arrow $A_1$, to move the latch about hinge 52, as is discussed in further detail below. As illustrated in FIGS. 2 and 4, but not necessary, upper push surface 46 may be stepped to assist the user in gripping connector member 14 and applying force to push surface 46. As shown in FIG. 9, lower surface 48 of push portion 44 includes sloped portion 48*a*. Push portion 44 also includes a pair of ribs 58 protruding from and extending along a portion of lower surface 48, as shown in FIGS. 7-10.

Figure 10:
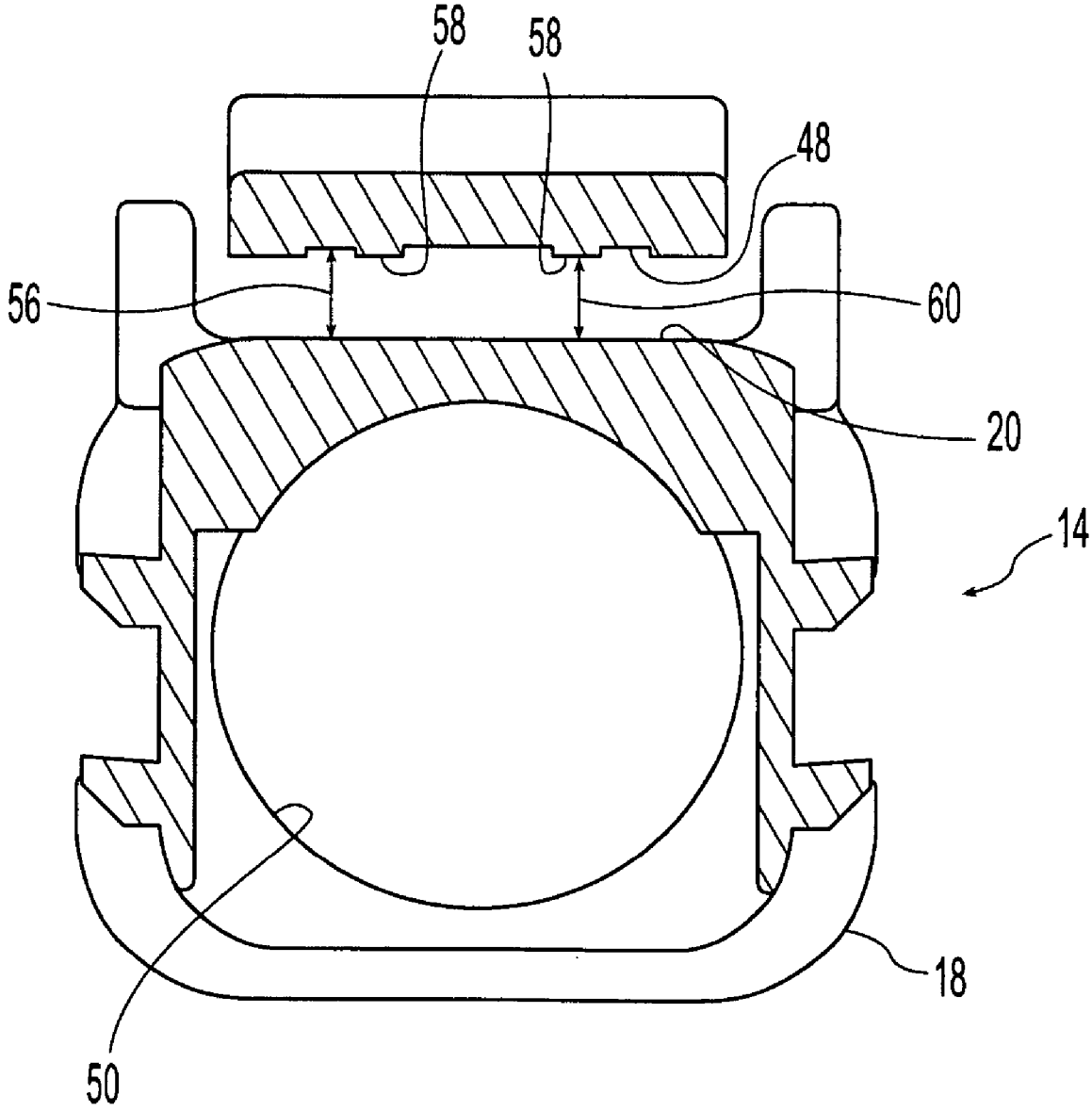
FIG. 10 is a sectional view of the connector member of FIG. 4 taken along line 10-10.

Turning now to FIGS. 2-4 and 7-9, hinge portion 52 of latch member 28 is hingedly coupled to housing 18, such that lower surface 48 is spaced from outer surface 20 of housing 18. Hinge portion 52 includes pair of spaced apart beams 52*a*, 52*b* extending from opposing sides 34*a*, 34*b* to housing 18. It should be understood that hinge portion 52, alternatively, may include a single beam or any number of beams. Beams 52*a*, 52*b* extend from sides 34*a*, 34*b* at a point between push end 30 and lock end 32 to provide axis P about which latch member 28 may pivot. Each of beams 52*a*, 52*b* includes curved portion 54 proximal latch member 28, as shown in FIGS. 4 and 9. Curved portion 54 curves away from lower surface 48 to form angle $\alpha$, which is about 90° relative to lower surface 48. Although the preferred embodiment illustrates angle $\alpha$ as being about 90°, angle $\alpha$ may vary. Referring now to FIGS. 7-10, in its natural (unpivoted) state, lower surface 48 is spaced from outer surface 20 of housing 18 to create space or distance 56 between lower surface 48 and outer surface 20. Also in this natural position, the underside of ribs 58 are spaced from outer surface 20 by space or distance 60, as illustrated in FIGS. 6, 7 and 10.

Figure 11:
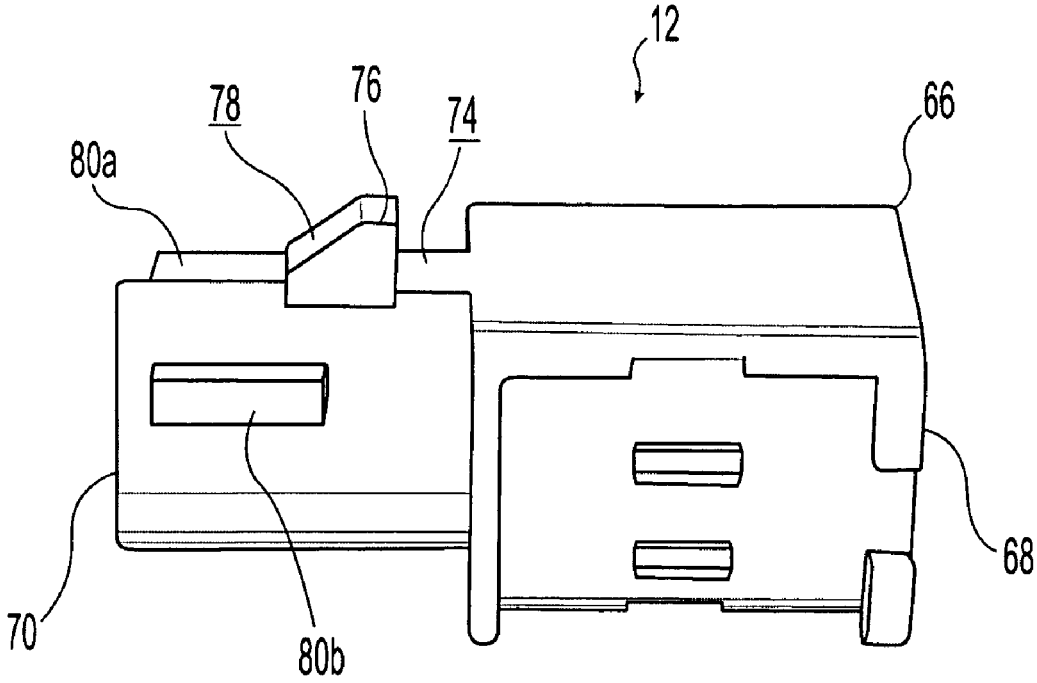
FIG. 11 is a side view of the first, male connector member of the connector assembly of FIG. 1.
Figure 12:
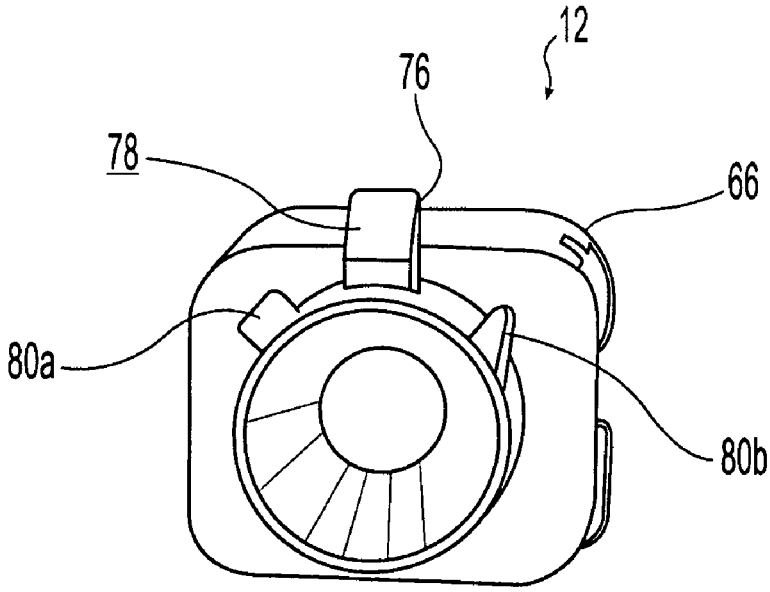
FIG. 12 is an end view of the connector member of FIG. 11.

Referring now to FIGS. 1 and 11-12, first connector member 12 will now be described. First connector member 12 includes housing 66, which has component end 68 and opposing connector end 70. Similar to second connector member 14, component end 68 defines opening 69 for receiving and holding a cable, which in turn connects to a component of an electronic device (not shown). Connector end 70 forms male member 72 which is configured to be received in male member receiving opening 26 (FIGS. 1, 2, 5 and 7). Fins or keying ribs 80*a*, 80*b* extend radially outward from the outside surface of male member 72 and are configured and positioned to be received within corresponding notches 27*a*, 27*b*. Housing 66 also includes outer surface 74 from which lock member 76 extends. Lock member 76 is configured to be received in lock receiving opening 38 (FIGS. 5 and 6) of latch member 28. Lock member 76 includes sloped surface 78, which is adapted to cooperate with sloped surface 40 (FIG. 5) of latch member 28 to facilitate insertion of lock member 76 into opening 38.

Turning now to FIGS. 1, 2, 5, 8, and 10, the operation of connector assembly 10 will now be described. Each of first and second connector members 12, 14 are coupled at their respective component ends 22, 68 to the cable assemblies (not shown) of respective electronic devices (not shown) in any conventional manner. Next, keying ribs 80*a*, 80*b* are aligned with notches 27*a*, 27*b*, respectively, and male member 72 of first connector member 12 is inserted into male member receiving opening 26 of second connector member 14 until sloped surface 40 (FIG. 2 or 7) of latch member 28 contacts sloped surface 78 of lock member 76. At this point male member 72 is pushed further into opening 26 such that sloped surfaces 40 and 78 slide against/along one another, forcing lock end 32 of latch member 28 to deflect away from outer surface 20 of housing 18. Lock member 76 is then able to pass under sloped surface 40 and into lock receiving opening 38, at which point hinge members 52*a*, 52*b* bias lock end 32 back toward housing 18 thereby capturing lock member 76 in opening 38 and securing first connector member 12 to second connector member 14. As the edge of lock member 76 passes the edge of opening 38 and hinge members 52*a*, 52*b* bias lock end 32 back toward housing 18, an audible "click" is generated so that the user is notified that the engagement is secure.

Referring to FIGS. 1 and 2, to disconnect first and second connector members 12, 14 from one another, force is applied to push surface 46 of latch member 28 in the direction of arrow $A_1$, which urges push portion 44 and its lower surface 48 toward outer surface 20 of housing 18. As a result, latch member 28 hinges at beams 52*a*, 52*b* such that lock portion 36 is urged upward in the direction of arrow $A_2$ away from outer surface 20 of housing 18. With lock portion 36 deflected away from housing 18, lock member 76 of first connector member 12 is freed from lock receiving opening 38 and first connector member 12 may be pulled apart from second connector 14 to disengage male member 72 from lock engagement portion 36. Ribs 58 (FIGS. 7 and 10) on lower surface 48 of latch member 28 act as stop device, such that when push portion 44 is pushed close to housing 18, the underside of ribs 58 contact outer surface 20 of housing 18 to thereby prevent further deflection of latch member 28 and stress on hinge 52.

The curvature of hinge beams 52*a*, 52*b* lends to hinge 52 a robustness that resists damage to and fracturing of hinge 52. In addition the curved hinge beams 52*a*, 52*b* strongly urges latch member 28 to its natural (non-pivoted) state to thereby cause a reliable audible "click" sound after lock member 76 is properly received in lock receiving opening 38. Ribs 58 cooperate with outer surface 20 of housing 18 to further protect hinge 52 from overstress and fracture. Connector assembly 10 provides for a strong secure connection between electronic components that would meet industry standards and, yet, provides a simple and effective means of deliberately disengaging the connection.

Both first and second connectors 12, 14 may be made of any material suitable for use in forming electrical connectors including, for example, plastic. Housing 18, latch member 28 and hinge 52 of second connector 14 may be formed of the same or different materials and may be formed either as separate parts that are then assembled, or as a single integral unit. For example, second connector 14 may be formed of a plastic material that is rigid enough to couple with and hold the contacts of the electrical device, but capable of providing beams 52*a*, 52*b* with a resiliency that allows deflection of latch member 28. First and second connector members 12, 14 may be formed using any known method including, for instance, injection molding, extrusion or other manufacturing methods. Although ribs 58 are positioned on lower surface 48 in the embodiments described above, the stop ribs may be alternatively positioned on and extend upwardly from the surface of the housing toward the lower surface of the latch member.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An electrical connector assembly comprising:

a first connector member having a first housing and a lock member protruding from said first housing; and a second connector member releasably engaged with said first connector member, said second connector member including a second housing and a latch member, said latch member including a lower surface spaced apart from and facing a surface of said second housing, a hinge portion hingedly attached to said surface of said second housing, a lock engagement portion at one end, and a push portion at an end of said latch member opposite said lock engagement portion, said hinge portion comprising a pair of beams extending from said lower surface of said latch member to said surface of said second housing, at least one beam of said pair of beams curving at an angle extending from said lower surface, said connector assembly having a locked position wherein said lock engagement portion engages said lock member to releasably lock said second connector member in engagement with said first connector member and a released position wherein said lock member is released from said lock engagement portion, said push portion having at least one rib protruding from said lower surface and an upper push surface configured to receive a force, said force operable to pivot said latch member at said hinge portion and move said lock engagement portion from said locked position to said released position.

2. The electrical connector assembly of claim 1 wherein one of said angle is about 90°.

3. The electrical connector assembly of claim 1, wherein said hinge portion is located intermediate said lock engagement portion and said push portion.

4. The electrical connector assembly of claim 1, wherein said push portion, hinge, and lock engagement portion are located relative to each other such that movement of said push portion results in inverse movement of said lock engagement portion.

5. The electrical connector assembly of claim 1, wherein said first housing has an outer surface and said lock member protrudes outwardly from said outer surface.

6. The electrical connector assembly of claim 1, wherein said lock engagement portion includes a bore therethrough sized and shaped to receive said lock member therein.

7. An electrical connector assembly comprising:

a first connector member having a first housing and a lock member protruding from said first housing; and a second connector member releasably engaged with said first connector member, said second connector member including a second housing and a latch member, said latch member including a lower surface, a hinge portion hingedly attached to a surface of said second housing, opposing sides extending along a length of said latch member, and a lock engagement portion at one end, said hinge portion comprising a pair of beams extending from said lower surface of said latch member to said surface of said second housing, at least one beam of said pair of beams curving at an angle extending from said lower surface, said connector assembly having a locked position wherein said lock engagement portion engages said lock member to releasably lock said second connector member in engagement with said first connector member and a released position wherein said lock member is released from said lock engagement portion, said pair of beams spaced apart from one another and extending from opposing sides.

8. An electrical connector assembly for coupling a first electrical component to a second electrical component, the electrical connector comprising:

a first connector member attachable to the first electrical component, the first connector member having a first housing; and a second connector member attachable to the second electrical component, said second connector releasably engaged with said first connector member, said second connector member including a second housing and a latch member, said latch member including a hinge hingedly attaching the latch member to an outer surface of said second housing, said hinge including a pair of beams extending from said lower surface to said outer surface of said housing, said latch member including a push portion at one end and a lock engagement portion at an opposite end, said push portion having an upper push surface configured to receive a force and an opposing lower surface facing said outer surface of said second housing and defining a space between said outer surface and said push portion, wherein at least one of said lower surface and said outer surface includes at least one rib protruding into the space between said outer surface and said push portion, and at least one beam of said pair of beams having a curved portion curving to about 90 degrees from said lower surface.

9. The electrical connector of claim 8 wherein said lower surface includes said at least one rib.

10. The electrical connector of claim 8 wherein said first connector member further includes a lock member protruding from said first housing, said lock engagement portion is movable between a locked position wherein said lock engagement portion engages said lock member and a released position wherein said lock engagement portion is released from said lock member, said force operable to pivot said latch member at said hinge and move said lock engagement portion from said locked position to said released position.

11. The electrical connector of claim 8 wherein said latch member has opposing sides extending between said opposing ends of said latch member, said pair of beams spaced apart from one another and disposed proximal said opposing sides of said latch member.

12. The electrical connector of claim 8 wherein one of said first and second housings forms a male member and the other of said first and second housings forms a female member, said female member receiving said male member to releasably engage said first connector member with said second connector member.

13. The electrical connector assembly of claim 8, wherein said hinge portion is located intermediate said lock engagement portion and said push portion.

14. The electrical connector assembly of claim 8, wherein said push portion, hinge, and lock engagement portion are located relative to each other such that movement of said push portion results in inverse movement of said lock engagement portion.

15. The electrical connector assembly of claim 8, wherein said lock engagement portion includes a bore therethrough sized and shaped to receive a lock member of said first connector therein.

16. An electrical connector for releasably coupling with a connector of a first electrical component to couple the first electrical component with a second electrical component, the connector of the first electrical component having a lock member protruding from therefrom, the electrical connector comprising:

a housing having a component end adapted to attach to the second electrical component and a connector end adapted to couple with the connector of the first electrical component and said housing having an outer surface; and a latch member, said latch member including a push portion at one end and a lock engagement portion at an opposite end, said push portion having an upper push surface configured to receive a force and an opposing lower surface facing said outer surface of said housing and defining a space between said outer surface and said push portion, said latch member including a hinge hingedly attaching said latch member to said outer surface of said housing, said hinge comprising at least one beam extending from said lower surface to said outer surface of said housing, said at least one beam having a curve portion curving 90 degrees from said lower surface;

wherein at least one of said lower surface and said outer surface includes at least one rib protruding into the space between said outer surface and said push portion.

17. The electrical connector of claim 16 wherein said lock engagement portion is movable between a locked position wherein said lock engagement portion is engagable with said lock member to lock the connector end of the housing in engagement with the connector of the first electrical component and a released position wherein said lock engagement portion is releasable from said lock member, said force operable to pivot said latch member at said hinge and move said lock engagement portion from said locked position to said released position.

18. The electrical connector of claim 16 wherein the at least one beam includes a pair of beams, said latch member has opposing sides extending between said opposing ends of said latch member, said pair of beams spaced apart from one another and disposed proximal said opposing sides of said latch member.

19. The electrical connector of claim 16 wherein said lower surface includes at least one rib protruding into the space between said outer surface and said push portion.

* * * * *